US011588244B2

(12) United States Patent
Chan et al.

(10) Patent No.: US 11,588,244 B2
(45) Date of Patent: Feb. 21, 2023

(54) ANTENNA STRUCTURE

(71) Applicants: Chun-Cheng Chan, Taipei (TW); Shih-Chia Liu, Taipei (TW); Yen-Hao Yu, Taipei (TW); Li-Chun Lee, Taipei (TW); Chao-Lin Wu, Taipei (TW); Jui-Hung Lai, Taipei (TW); Chih-Heng Lin, Taipei (TW)

(72) Inventors: Chun-Cheng Chan, Taipei (TW); Shih-Chia Liu, Taipei (TW); Yen-Hao Yu, Taipei (TW); Li-Chun Lee, Taipei (TW); Chao-Lin Wu, Taipei (TW); Jui-Hung Lai, Taipei (TW); Chih-Heng Lin, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 278 days.

(21) Appl. No.: 16/995,784

(22) Filed: Aug. 17, 2020

(65) Prior Publication Data

US 2021/0280973 A1 Sep. 9, 2021

(30) Foreign Application Priority Data

Mar. 3, 2020 (TW) ..... 109106932

(51) Int. Cl.

| | |
|---|---|
| ***H01Q 1/52*** | (2006.01) |
| ***H01Q 5/371*** | (2015.01) |
| ***H01Q 9/42*** | (2006.01) |

(52) U.S. Cl.

CPC ..... *H01Q 5/371* (2015.01); *H01Q 1/521* (2013.01); *H01Q 9/42* (2013.01)

(58) Field of Classification Search

CPC ..... H01Q 5/371; H01Q 1/38; H01Q 9/0407; H01Q 9/42; H01Q 1/521; H01Q 1/12;

(Continued)

(56) References Cited

U.S. PATENT DOCUMENTS

| | | | |
|---|---|---|---|
| 7,330,156 B2 | 2/2008 | Arkko et al. | |
| 2016/0285161 A1* | 9/2016 | Apaydin | H01Q 1/525 |

(Continued)

FOREIGN PATENT DOCUMENTS

| | | |
|---|---|---|
| CN | 102832448 | 12/2012 |
| TW | 201301660 | 1/2013 |

(Continued)

OTHER PUBLICATIONS

"Office Action of Taiwan Counterpart Application", dated Nov. 13, 2020, p. 1-p. 8.

(Continued)

*Primary Examiner* — David E Lotter
(74) *Attorney, Agent, or Firm* — JCIPRNET

(57) ABSTRACT

The disclosure provides an antenna structure, including at least one supporting module, a first antenna, and a second antenna. The first antenna is disposed on the at least one supporting module and includes a first feeding point and a first zero-current zone. The first antenna is connected to a ground plane. The second antenna is disposed on the at least one supporting module and includes a second feeding point and a second zero-current zone. The second antenna is connected to the ground plane. The first feeding point of the first antenna is disposed in the second zero-current zone of the second antenna, and the second feeding point of the second antenna is disposed in the first zero-current zone of the first antenna.

22 Claims, 24 Drawing Sheets

(58) Field of Classification Search
CPC ..... H01Q 1/48; H01Q 1/50; H01Q 21/00; H01Q 21/0006
See application file for complete search history.

(56) References Cited

U.S. PATENT DOCUMENTS

| | | | | |
|---|---|---|---|---|
| 2017/0062932 | A1* | 3/2017 | Foster | H01Q 1/38 |
| 2021/0126368 | A1* | 4/2021 | Hsiao | H01Q 1/38 |

FOREIGN PATENT DOCUMENTS

| | | |
|---|---|---|
| TW | 201507268 | 2/2015 |
| TW | M593665 | 4/2020 |

OTHER PUBLICATIONS

"Office Action of Taiwan Related Application, Application No. 110125946", dated May 9, 2022, p. 1-p. 6.

* cited by examiner

ANTENNA STRUCTURE

CROSS-REFERENCE TO RELATED APPLICATION

This application claims the priority benefit of Taiwan application serial no. 109106932, filed on Mar. 3, 2020. The entirety of the above-mentioned patent application is hereby incorporated by reference herein and made a part of this specification.

BACKGROUND

Technical Field

The disclosure relates to an antenna structure, and in particular, to an antenna structure with an isolation mechanism.

Description of Related Art

In existing antenna designs, to reduce the size of an antenna, two planar inverted-F antennas (PIFA) with a ¼-wavelength resonance structure are often used for coupling. However, if no additional design is provided in the overall antenna structure to increase isolation, the performance of the antenna structure may be affected because the two antennas interfere with each other.

FIG. 1A shows a conventional antenna structure without an isolation mechanism and a diagram of scattering coefficients of related antennas. As shown in FIG. 1A, when no isolation component is disposed between an antenna 1 and an antenna 2 which are disposed side by side, the performance of the antenna 1 and the antenna 2 in a working band is affected due to poor isolation.

To improve isolation, an additional ¼-wavelength resonance structure is generally disposed between the two antennas as an isolation component, as shown in FIG. 1B.

In addition, there is also a conventional configuration in which a ½-wavelength closed-slot antenna is disposed adjacent to a ¼-wavelength PIFA, which can achieve good isolation by using different resonance mechanisms between the antennas, as shown in FIG. 1C.

Although the designs shown in FIG. 1B and FIG. 1C can provide relatively good isolation, the configuration in which the antennas and the isolation component are disposed side by side correspondingly results in a larger size.

SUMMARY

In view of this, the disclosure provides an antenna structure, which can be used to resolve the above technical problems.

The disclosure provides an antenna structure, including at least one supporting module, a first antenna, and a second antenna. The first antenna is disposed on the at least one supporting module and includes a first feeding point and a first zero-current zone. The first antenna is connected to a ground plane. The second antenna is disposed on the at least one supporting module and includes a second feeding point and a second zero-current zone. The second antenna is connected to the ground plane. The first feeding point of the first antenna is disposed in the second zero-current zone of the second antenna, and the second feeding point of the second antenna is disposed in the first zero-current zone of the first antenna.

Based on the above, the antenna structure of the disclosure can provide good isolation for the first antenna and the second antenna without disposing an additional isolation component.

DESCRIPTION OF THE EMBODIMENTS

Figure 2A:
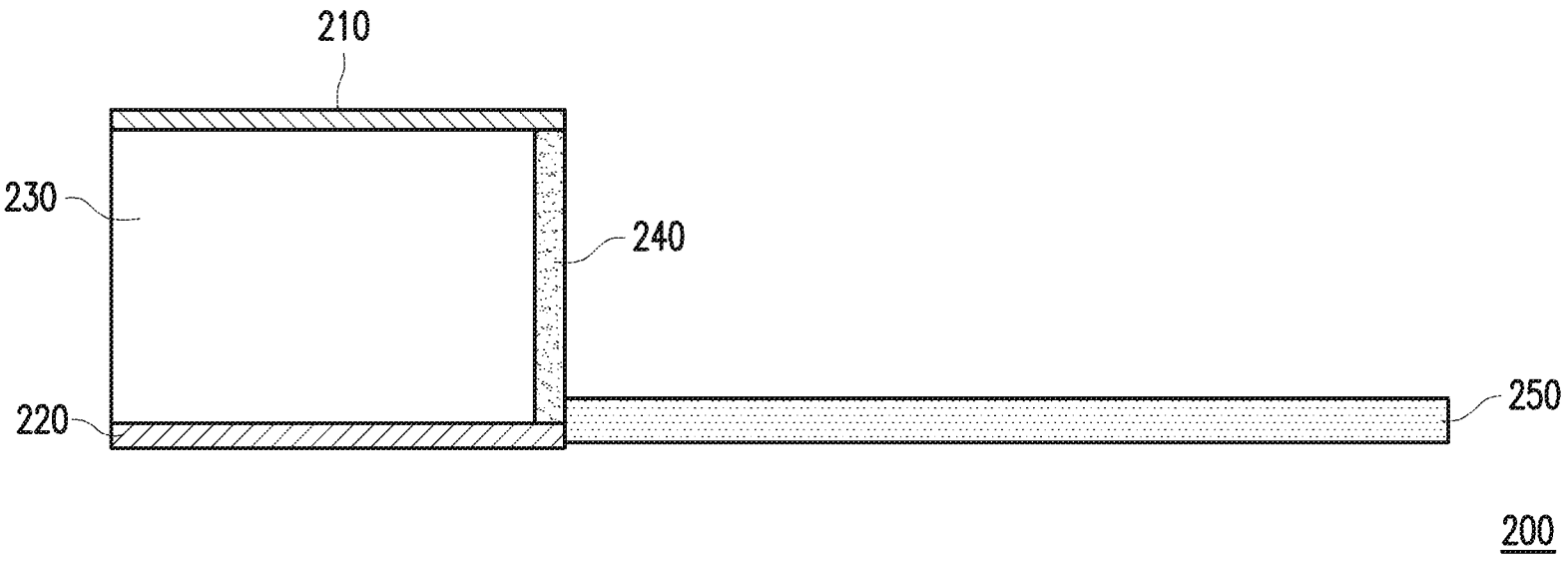
FIG. 2A is a side view of an antenna structure according to an embodiment of the disclosure.
Figure 2B:
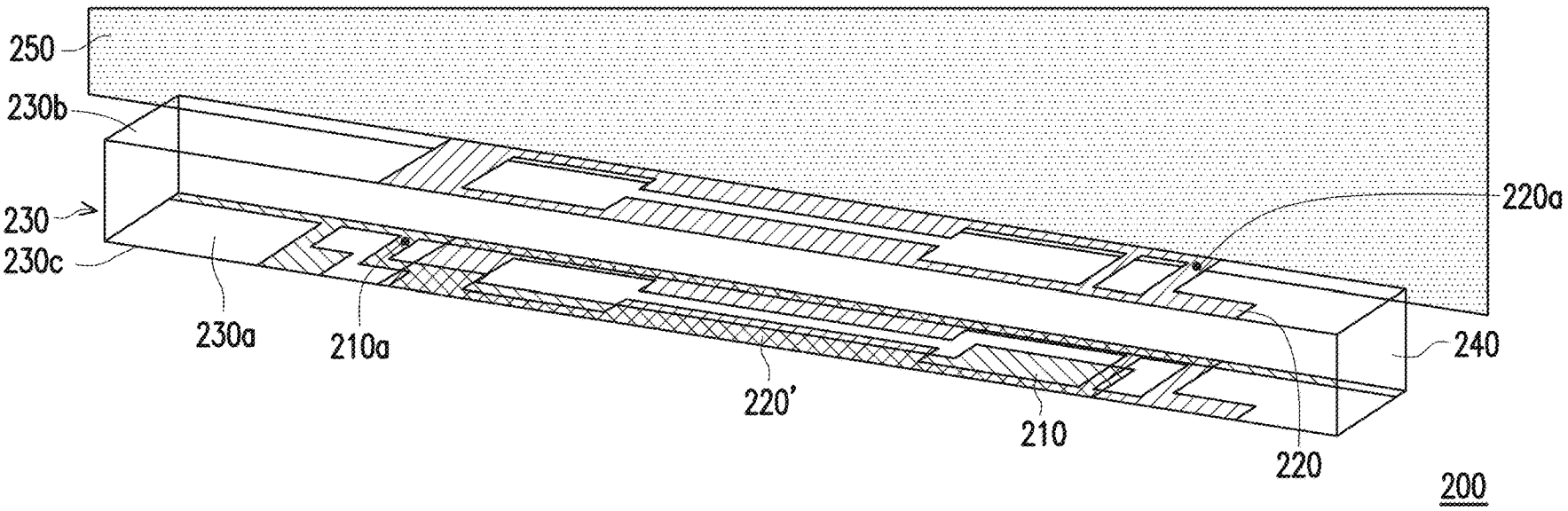
FIG. 2B is a schematic three-dimensional diagram of the antenna structure according to FIG. 2A.

FIG. 2A is a side view of an antenna structure according to an embodiment of the disclosure. FIG. 2B is a schematic three-dimensional diagram of the antenna structure according to FIG. 2A. As shown in FIG. 2A and FIG. 2B, an antenna structure 200 includes a first antenna 210, a second antenna 220, a supporting module 230, and a metal layer 240. The first antenna 210, the second antenna 220, and the metal layer 240 are all disposed on the supporting module 230. It should be understood that, for a clearer view, the supporting module 230 in FIG. 2B is shown as a structure of a transparent cuboid, but the disclosure is not limited thereto.

In the present embodiment of the disclosure, the first antenna 210 may include a first feeding point 210*a*, and the first antenna 210 may be connected to a ground plane 250 through the metal layer 240. In addition, the second antenna 220 may include a second feeding point 220*a*, and the second antenna 220 may also be connected to the ground plane 250 through the metal layer 240. Furthermore, patterns of the first antenna 210 and the second antenna 220 in FIG. 2B are shown for example only, and are not intended to limit possible implementations of the disclosure. It should be noted that, in other embodiments, the antenna structure 200 may not include the metal layer 240, and the ground plane 250 may have a certain height so that the first antenna 210 and the second antenna 220 are directly connected to the ground plane 250.

In FIG. 2A and FIG. 2B, the first antenna 210 may be disposed on a first surface 230*a* of the supporting module 230, the second antenna 220 may be disposed on a second surface 230*b* of the supporting module 230, and the first surface 230*a* may be opposite to the second surface 230*b*, but the disclosure is not limited thereto.

In other embodiments, the first antenna 210 may include a first portion and a second portion, the first portion of the first antenna 210 may be disposed on the first surface 230*a* of the supporting module 230, and the second portion of the first antenna 210 may be disposed on/extend onto a third surface 230*c* (the third surface 230*c* is adjacent to the first surface 230*a*) of the supporting module 230, but the disclosure is not limited thereto. In addition, the second antenna 220 may also include a first portion and a second portion, the first portion of the second antenna 220 may be disposed on the second surface 230*b* of the supporting module 230, and the second portion of the second antenna 220 may be disposed on/extend onto the third surface 230*c* of the supporting module 230, but the disclosure is not limited thereto.

In FIG. 2B, an orthographic projection 220' of the second antenna 220 on the first surface 230*a* may partially overlap the first antenna 210. Similarly, an orthographic projection (not marked) of the first antenna 210 on the second surface 230*b* may also partially overlap the second antenna 220.

Figure 1A:
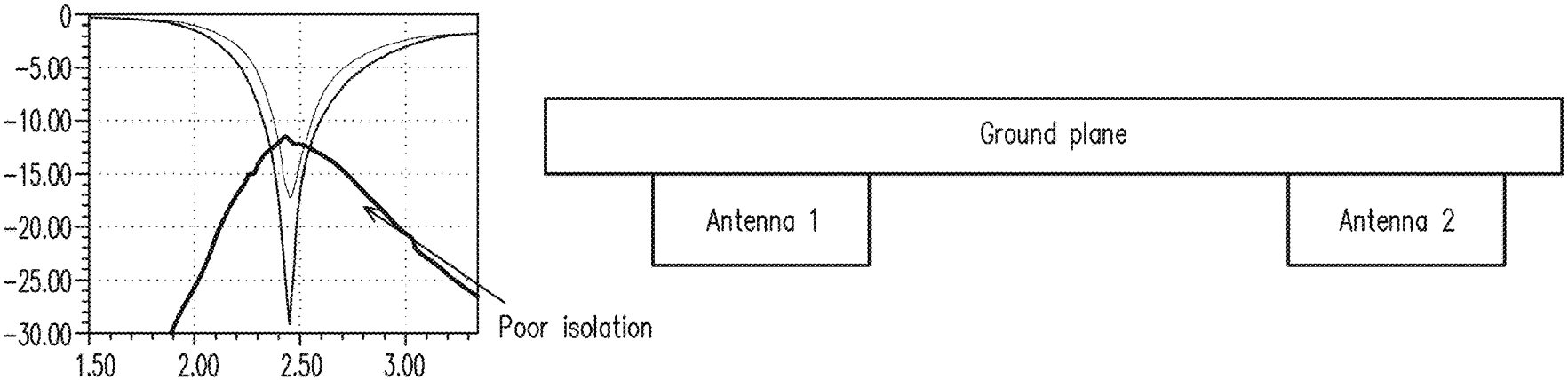
FIG. 1A shows a conventional antenna structure without an isolation mechanism and a diagram of scattering coefficients of related antennas.
Figure 1B:
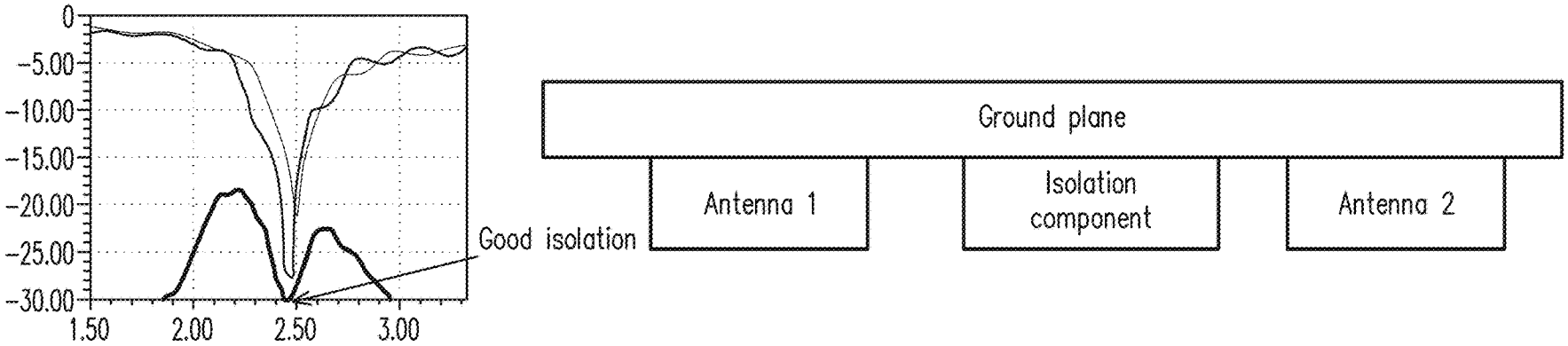
FIG. 1B and FIG. 1C are schematic diagrams of conventional antenna structures designed with isolation mechanisms.
Figure 1C:
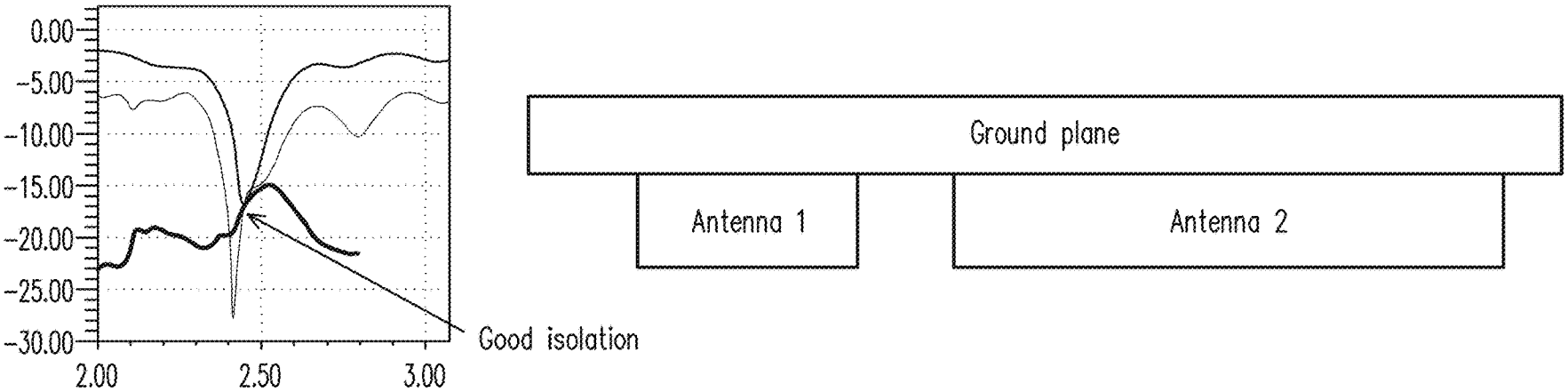

The first antenna 210 and the second antenna 220 are designed as a stack structure shown in FIG. 2B, so that the antenna structure 200 of the disclosure can have a smaller size than a conventional side-by-side antenna structure (for example, structures shown in FIG. 1B and FIG. 1C), thereby lowering a space requirement.

In the present embodiment of the disclosure, the first feeding point 210*a* of the first antenna 210 may be configured to receive a first excitation signal, and the first antenna 210 may be excited correspondingly by the first excitation signal to form a first zero-current zone. A related formation principle will be described below in detail with reference to FIG. 3A. In an embodiment, the first zero-current zone may be distributed on at least one of the metal layer 240, the ground plane 250, the first antenna 210, and the second antenna 220.

Similarly, the second feeding point 220*a* of the second antenna 220 may be configured to receive a second excitation signal, and the second antenna 220 may be excited correspondingly by the second excitation signal to form a second zero-current zone. A related formation principle will be described below in detail with reference to FIG. 3B. In an embodiment, the second zero-current zone may be distributed on at least one of the metal layer 240, the ground plane 250, the first antenna 210, and the second antenna 220.

In this case, to increase isolation between the first antenna 210 and the second antenna 220, the first feeding point 210*a* of the first antenna 210 may be disposed in the second zero-current zone corresponding to the second antenna 220, and the second feeding point 220*a* of the second antenna 220 may be disposed in the first zero-current zone corresponding to the first antenna 210.

Figure 3A:
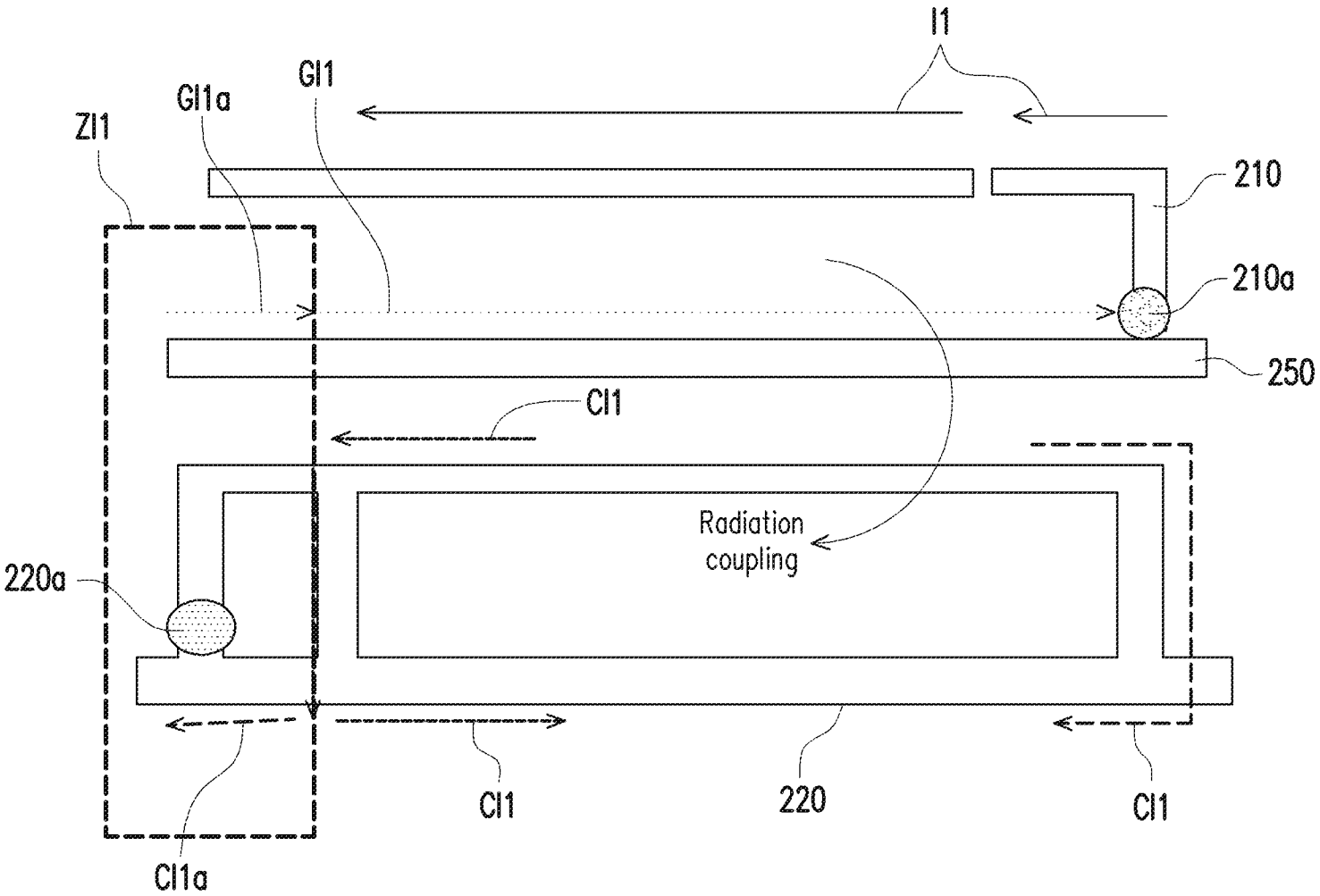
FIG. 3A is a schematic diagram of exciting a first antenna to form a first zero-current zone according to FIG. 2A and FIG. 2B.

FIG. 3A is a schematic diagram of exciting the first antenna to form the first zero-current zone according to FIG. 2A and FIG. 2B. In FIG. 3A, after the first feeding point 210*a* receives the first excitation signal, correspondingly, a first current I1 may be formed on the first antenna 210, and a first ground current GI1 may be formed on the ground plane 250. In addition, the excited first antenna 210 may form a first coupling current CI1 on the second antenna 220 by a radiation coupling mechanism. In this case, a partial ground current GI1*a* of the first ground current GI1 and a partial coupling current CI1*a* of the first coupling current CI1 may be offset by each other to form the first zero-current zone ZI1 corresponding to the first antenna 210. It should be understood that, an area (shown in dashed lines) of the first zero-current zone ZI1 in FIG. 3A is shown for example only, and is not intended to limit implementations of the disclosure.

Figure 3B:
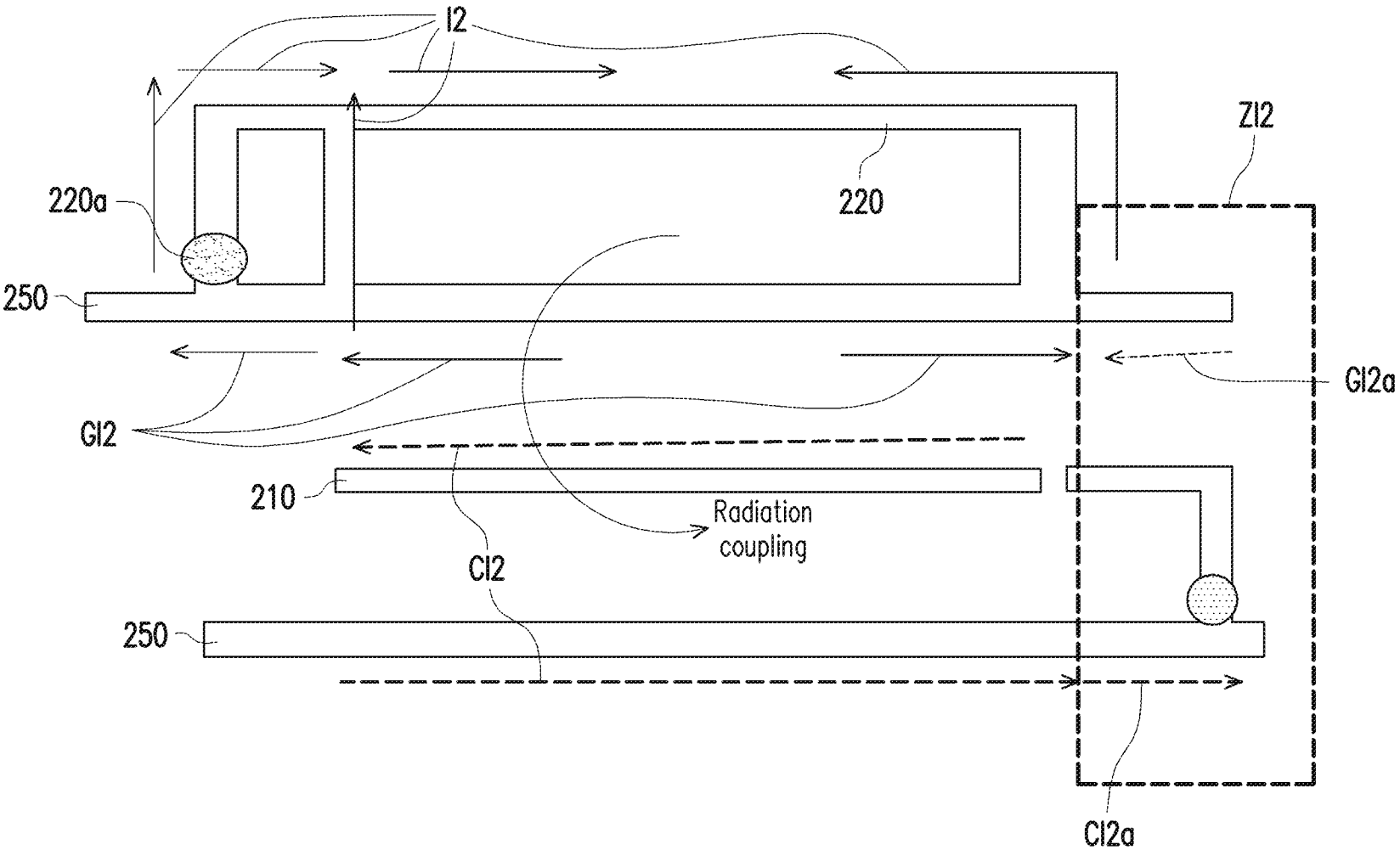
FIG. 3B is a schematic diagram of exciting a second antenna to form a second zero-current zone according to FIG. 2A and FIG. 2B.

FIG. 3B is a schematic diagram of exciting the second antenna to form the second zero-current zone according to FIG. 2A and FIG. 2B. In FIG. 3B, after the second feeding point 220*a* receives the second excitation signal, correspondingly, a second current I2 may be formed on the second antenna 220, and a second ground current GI2 may be formed on the ground plane 250. In addition, the excited second antenna 220 may form a second coupling current CI2 on the first antenna 210 by the radiation coupling mechanism. In this case, a partial ground current GI2*a* of the second ground current GI2 and a partial coupling current CI2*a* of the second coupling current CI2 may be offset by each other to form the second zero-current zone ZI2 corresponding to the second antenna 220. It should be understood that, an area (shown in dashed lines) of the second zero-current zone ZI2 in FIG. 3B is shown for example only, and is not intended to limit implementations of the disclosure.

According to the teaching of the foregoing embodiments, to increase isolation between the first antenna 210 and the second antenna 220, the first feeding point 210*a* of the first antenna 210 may be disposed in the second zero-current zone ZI2 corresponding to the second antenna 220 as shown in FIG. 3B, and the second feeding point 220*a* of the second antenna 220 may be disposed in the first zero-current zone ZI1 corresponding to the first antenna 210 as shown in FIG. 3A.

Furthermore, when the two antennas are disposed close and without a proper isolation mechanism, one of the antennas transfers energy to the other antenna through mechanisms such as radiation coupling and ground current conduction, resulting in poor performance of an overall antennas. However, in the antenna structure 200 of the disclosure, the coupling current and the ground current can be offset by each other when the first antenna 210/the second antenna 220 is excited, so that good isolation can be provided without disposing an isolation component.

Figure 4A:
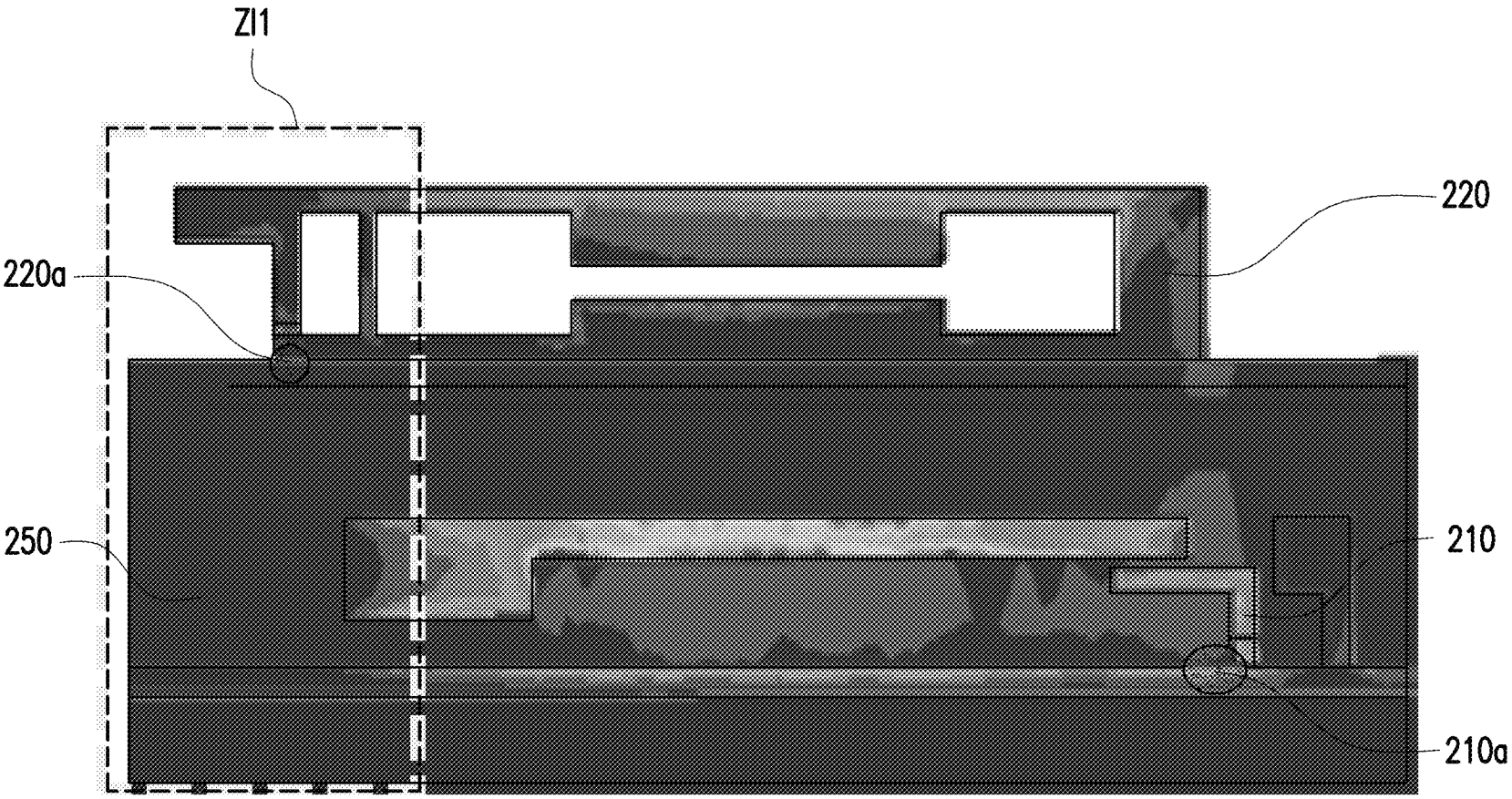
FIG. 4A is a schematic diagram of current intensity when the first antenna is excited according to FIG. 3A.

FIG. 4A is a schematic diagram of current intensity when the first antenna is excited according to FIG. 3A. As shown in FIG. 4A, when the first antenna 210 is excited, because the partial ground current GI1*a* and the partial coupling current CI1*a* may be offset by each other, the first zero-current zone ZI1 can be formed, in which the second feeding point 220*a* of the second antenna 220 is disposed.

Figure 4B:
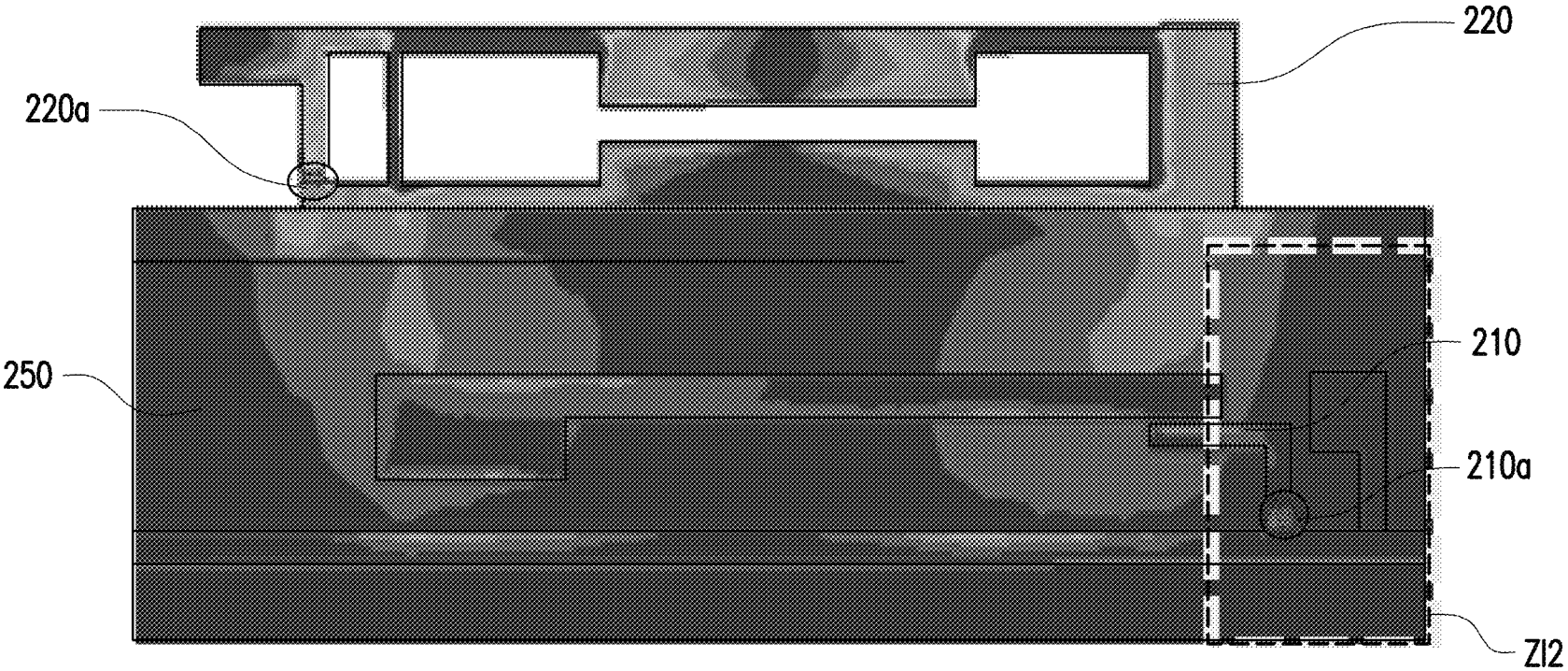
FIG. 4B is a schematic diagram of current intensity when the second antenna is excited according to FIG. 3B.

FIG. 4B is a schematic diagram of current intensity when the second antenna is excited according to FIG. 3B. As shown in FIG. 4B, when the second antenna 220 is excited, because the partial ground current GI2*a* and the partial coupling current CI2*a* may be offset by each other, the second zero-current zone ZI2 can be formed, in which the first feeding point 210*a* of the first antenna 210 is disposed.

Figure 5A:
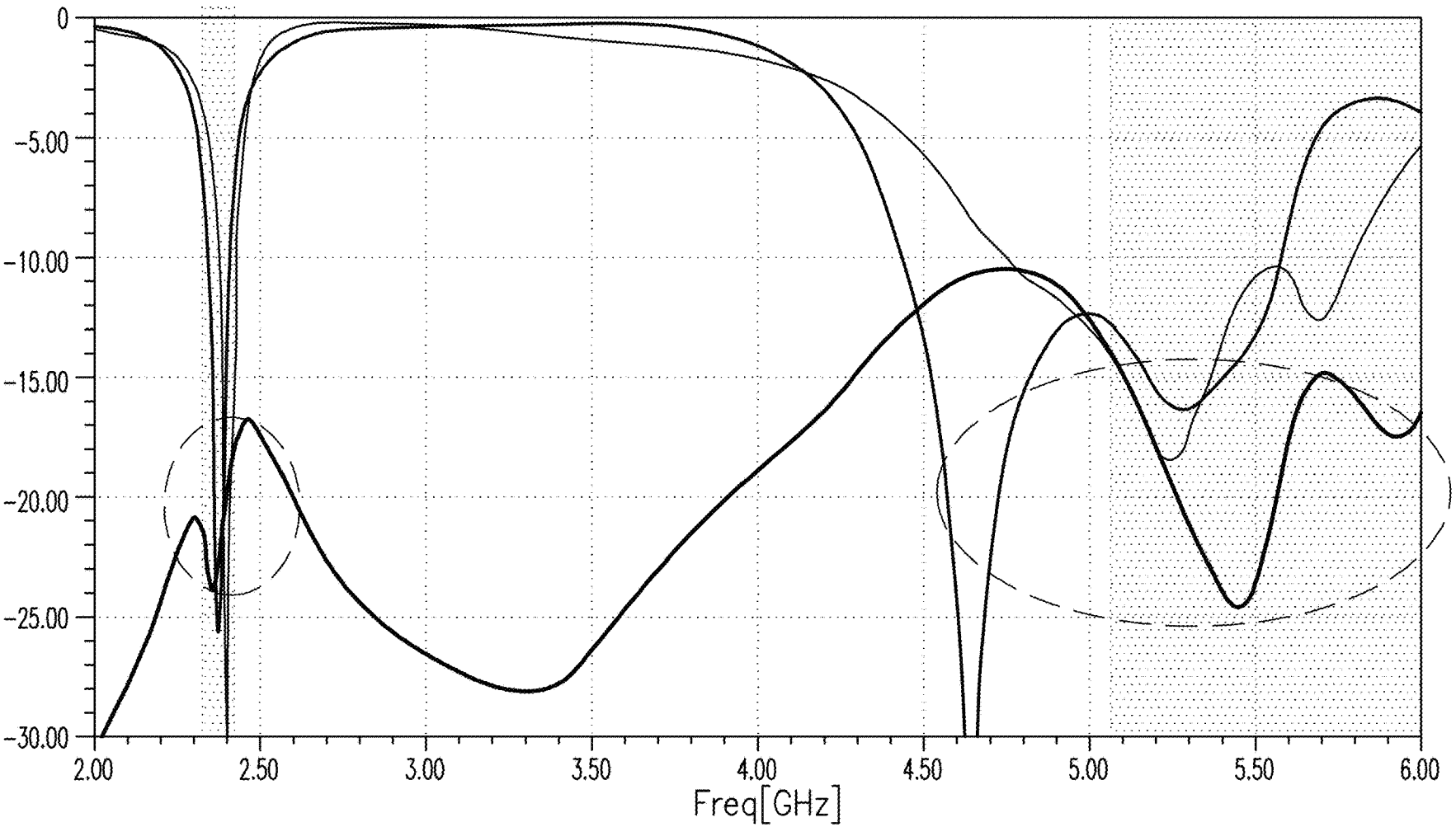
FIG. 5A and FIG. 5B are diagrams of scattering coefficients of antennas according to an embodiment of the disclosure.
Figure 5B:
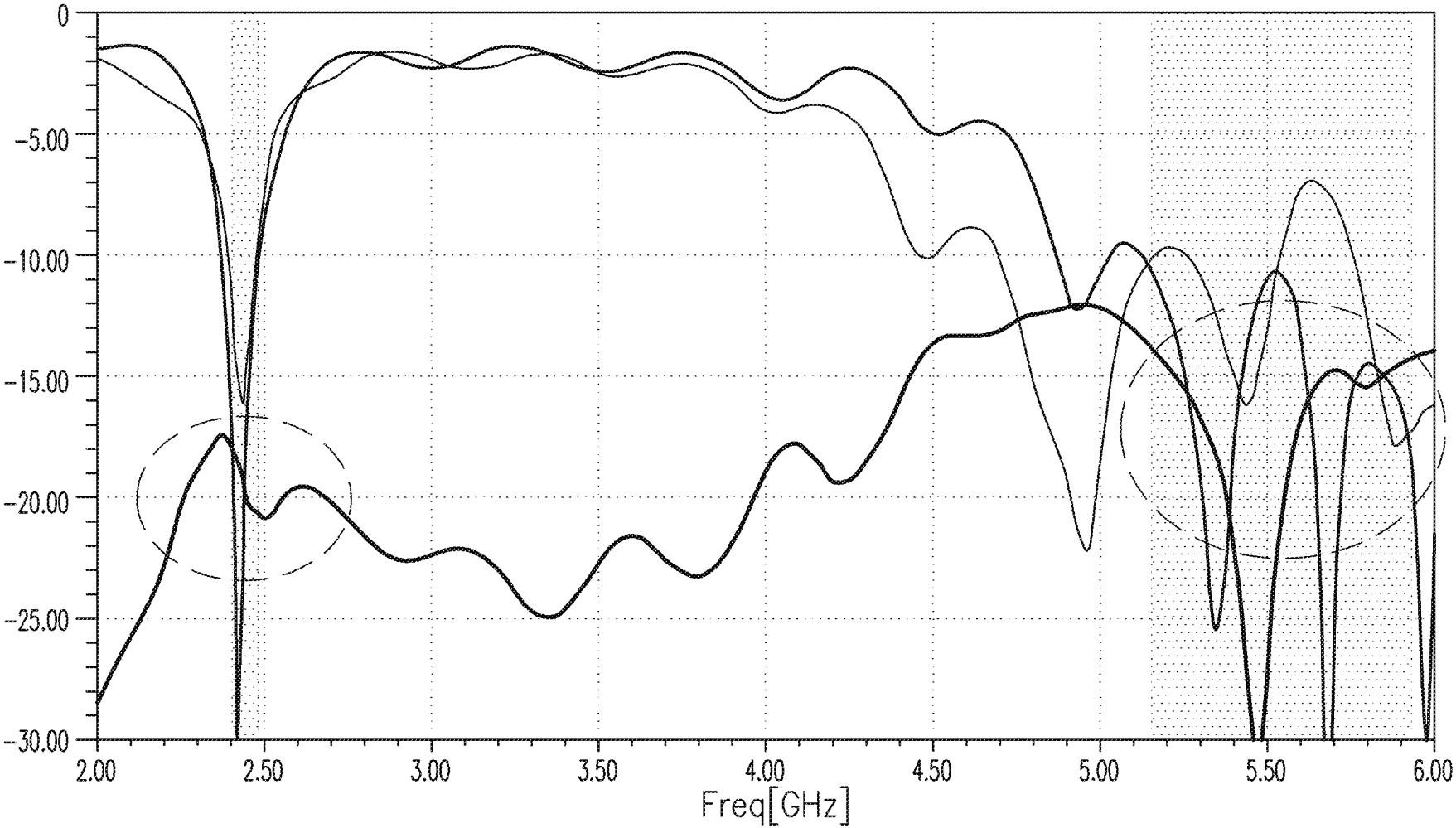

FIG. 5A and FIG. 5B are diagrams of scattering coefficients of antennas according to an embodiment of the disclosure. It can be seen from FIG. 5A and FIG. 5B that, the antenna structure of the disclosure can provide good isolation in relevant working bands (for example, a 2.4 to 2.5 GHz band and a 5.15 to 5.85 GHz band shown in circles).

In addition, in different embodiments, the first antenna and the second antenna in the antenna structure of the disclosure may be adjusted to structures different from the structure shown in FIG. 2B, as shown in FIG. 6A to FIG. 6D.

Figure 6A:
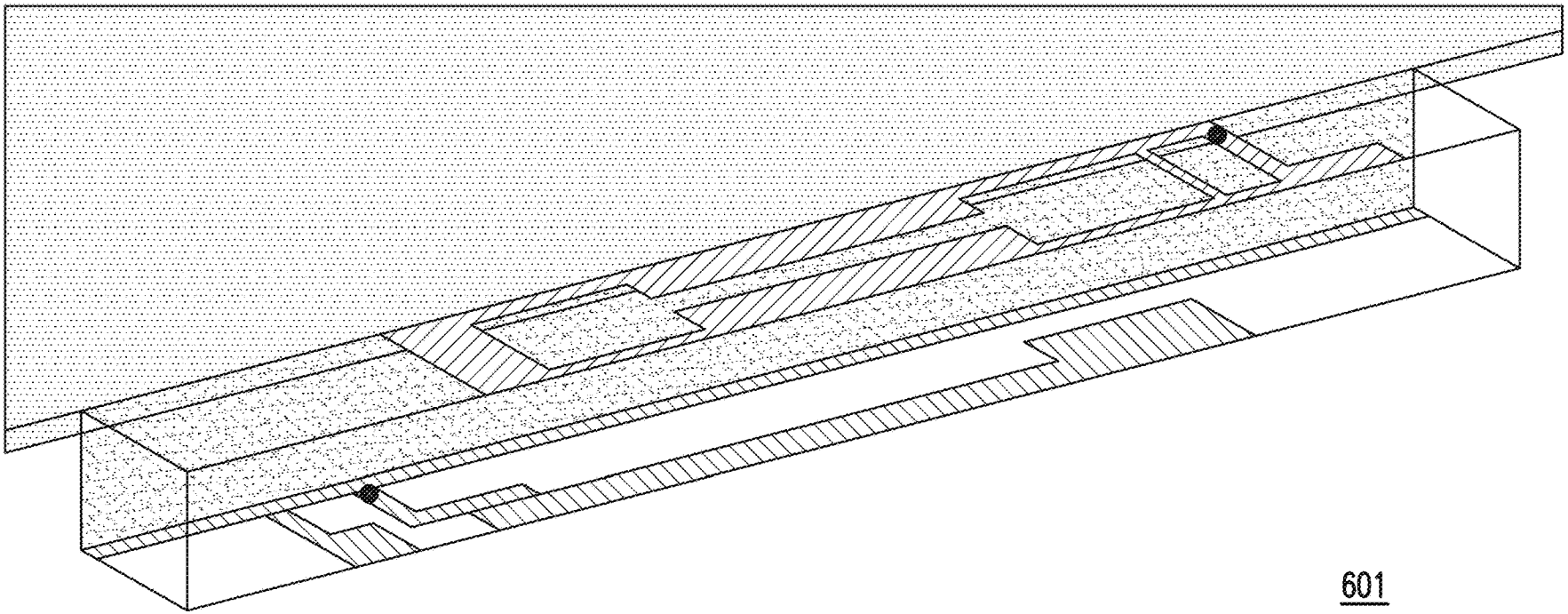
FIG. 6A to FIG. 6D are schematic diagrams of different antenna structures according to an embodiment of the disclosure.

As shown in FIG. 6A, in an antenna structure 601 of the disclosure, a structure of one of the first antenna and the second antenna may be a ½-wavelength double-end short-circuit structure, and a structure of the other of the first antenna and the second antenna may be a ½-wavelength double-end open-circuit structure.

Figure 6B:
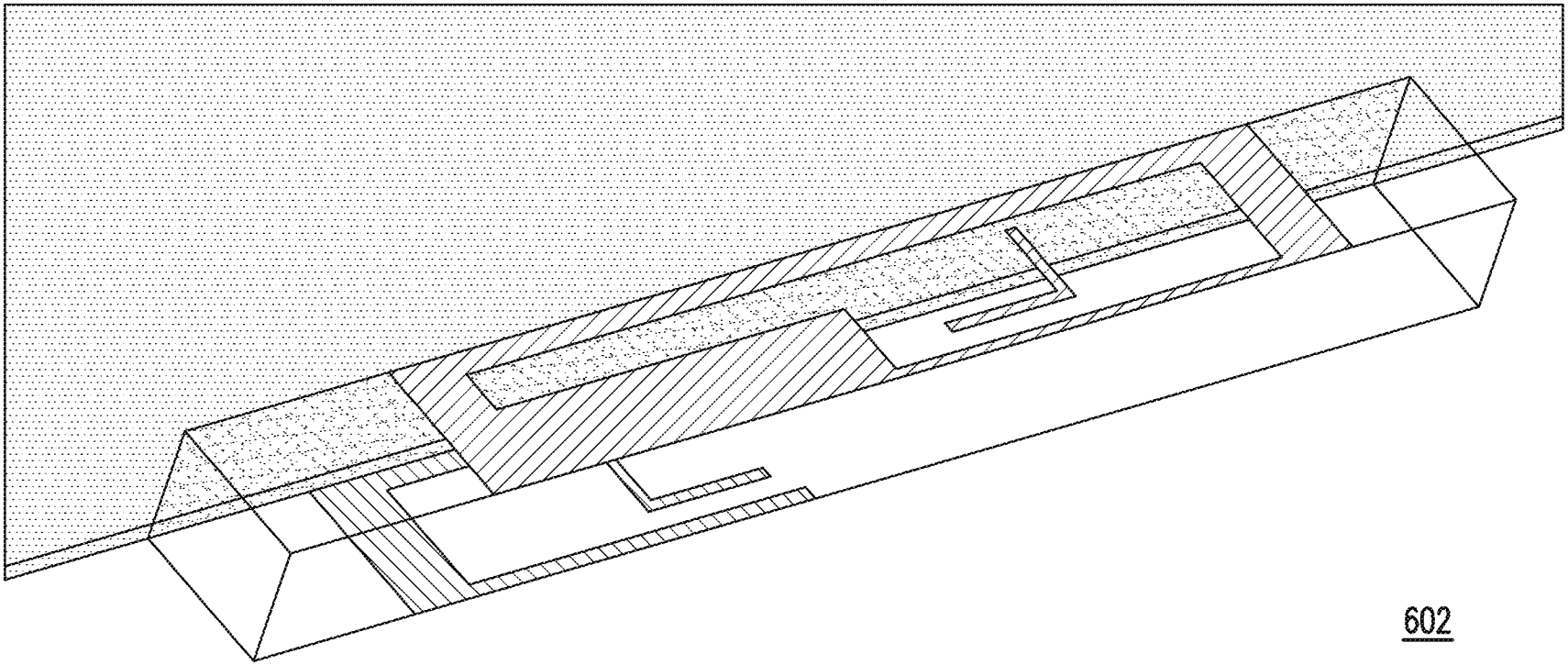

As shown in FIG. 6B, in an antenna structure 602 of the disclosure, a structure of one of the first antenna and the second antenna may be a ½-wavelength double-end short-circuit structure, and a structure of the other of the first antenna and the second antenna may be a ¼-wavelength resonance structure.

Figure 6C:
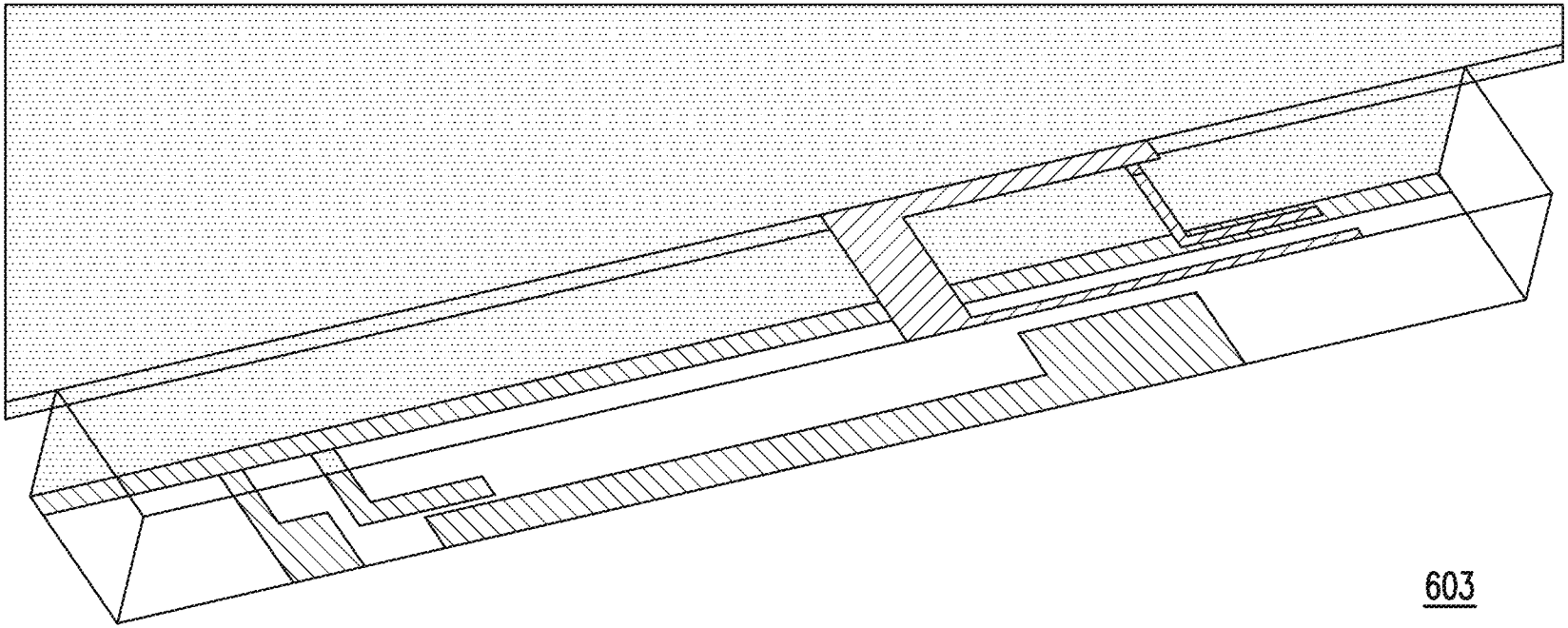

As shown in FIG. 6C, in an antenna structure 603 of the disclosure, a structure of one of the first antenna and the second antenna may be a ½-wavelength double-end open-circuit structure, and a structure of the other of the first antenna and the second antenna may be a ¼-wavelength resonance structure.

Figure 6D:
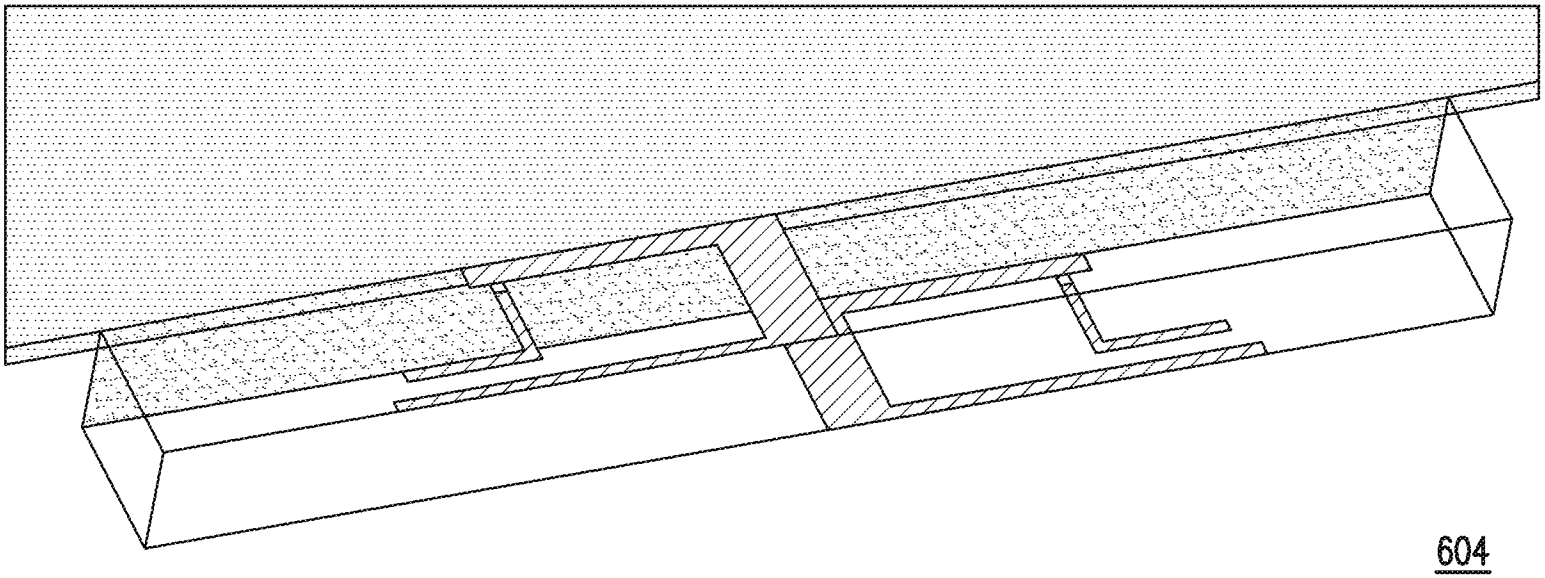

As shown in FIG. 6D, in an antenna structure 604 of the disclosure, structures of both the first antenna and the second antenna may be ¼-wavelength resonance structures.

It is tested that, as shown in FIG. 6A to FIG. 6D, regardless of whether the used first antenna and second antenna have the same or different structures, the antenna structure provided by the disclosure can provide good isolation between the first antenna and the second antenna.

Figure 7A:
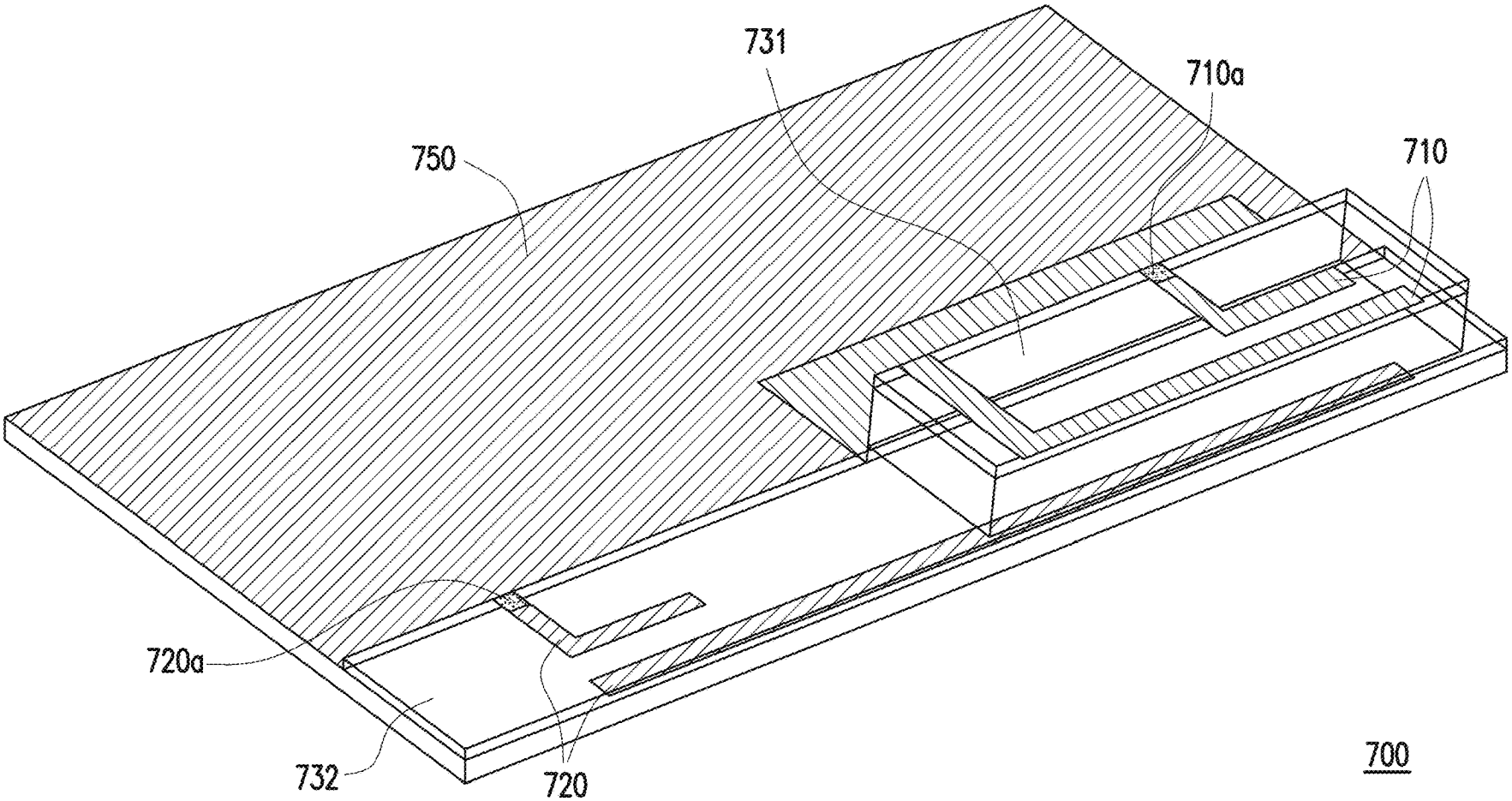
FIG. 7A is a schematic diagram of an antenna structure according to an embodiment of the disclosure.

FIG. 7A is a schematic diagram of an antenna structure according to an embodiment of the disclosure. As shown in FIG. 7A, a first antenna 710 and a second antenna 720 in an antenna structure 700 may be respectively disposed on supporting structures 731 and 732 of a supporting module, and may be connected to a ground plane 750. Similar to the foregoing embodiments, a first feeding point 710*a* of the first antenna 710 may be disposed in a second zero-current zone corresponding to the second antenna 720, and a second feeding point 720*a* of the second antenna 720 may be disposed in a first zero-current zone corresponding to the first antenna 710. In this way, costs and difficulty in design can be reduced.

Figure 7B:
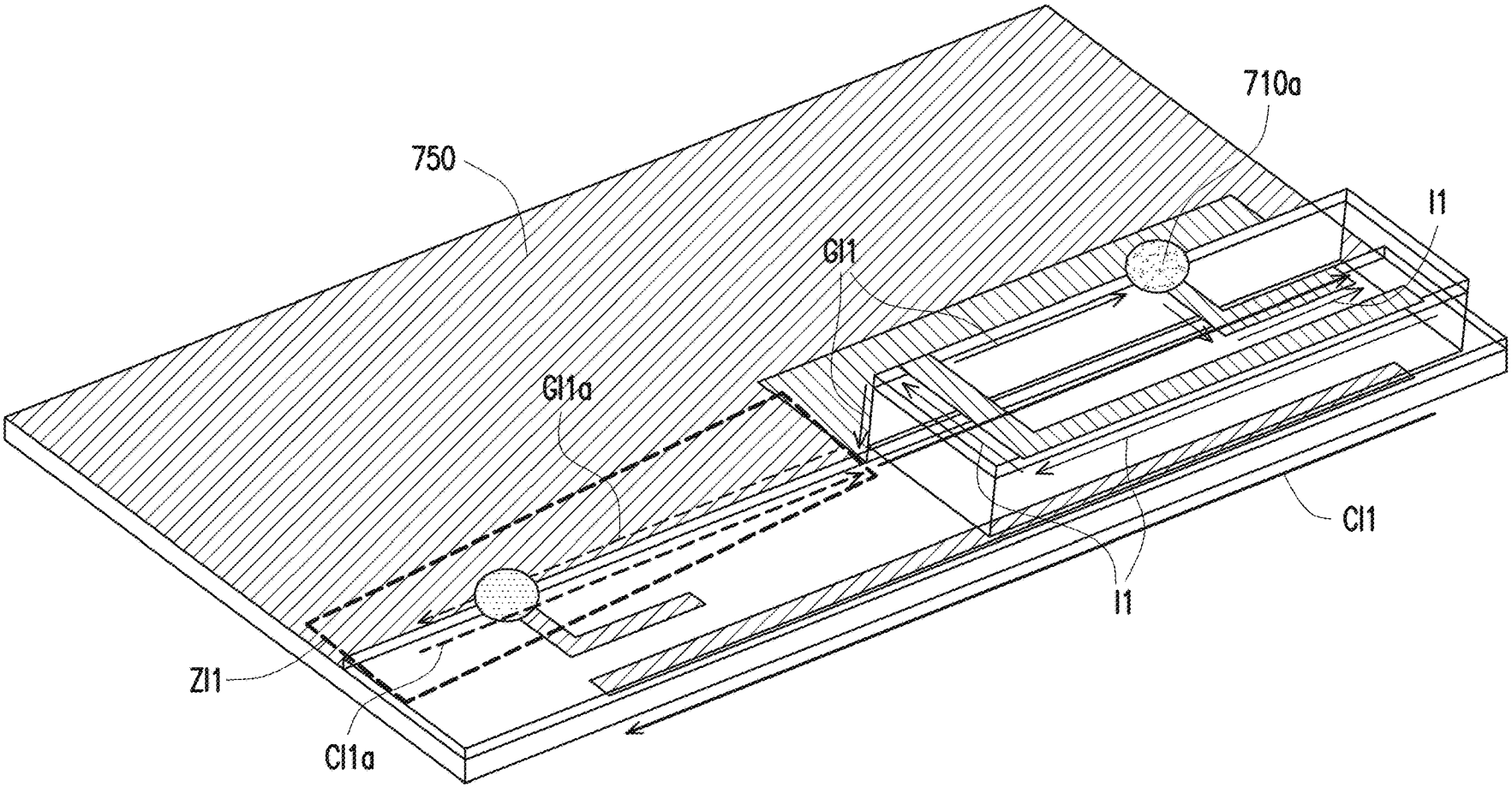
FIG. 7B is a schematic diagram of exciting a first antenna to form a first zero-current zone according to FIG. 7A.

FIG. 7B is a schematic diagram of exciting the first antenna to form the first zero-current zone according to FIG. 7A. In FIG. 7B, after the first feeding point 710*a* receives a first excitation signal, correspondingly, a first current I1 may be formed on the first antenna 710, and a first ground current GI1 may be formed on the ground plane 750. In addition, the excited first antenna 710 may form a first coupling current CI1 on the second antenna 720 by a radiation coupling mechanism. In this case, a partial ground current GI1*a* of the first ground current GI1 and a partial coupling current CI1*a* of the first coupling current CI1 may be offset by each other to form the first zero-current zone ZI1 corresponding to the first antenna 710. It should be understood that, an area (shown in dashed lines) of the first zero-current zone ZI1 in FIG. 7B is shown for example only, and is not intended to limit implementations of the disclosure.

Figure 7C:
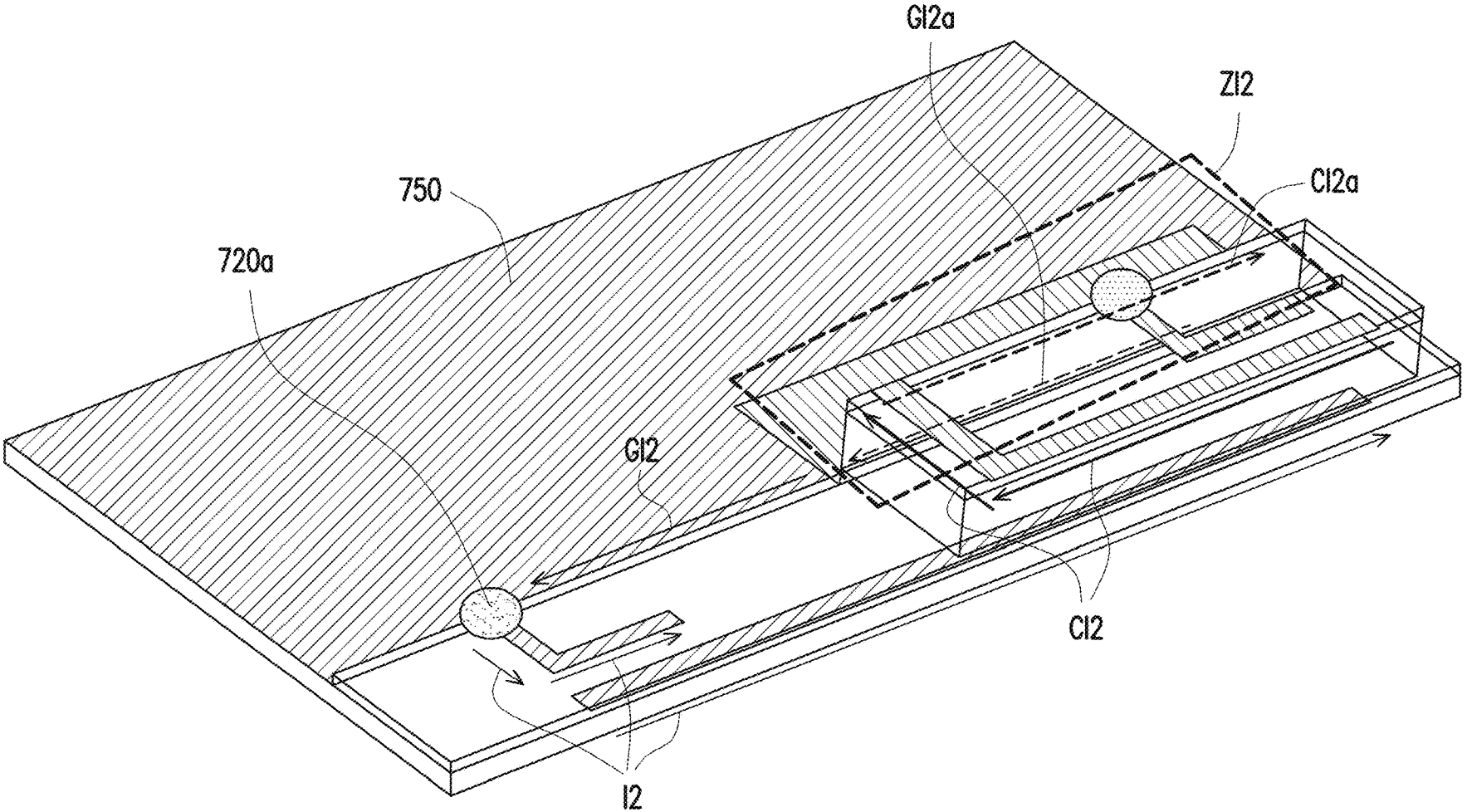
FIG. 7C is a schematic diagram of exciting a second antenna to form a second zero-current zone according to FIG. 7A and FIG. 7B.

FIG. 7C is a schematic diagram of exciting the second antenna to form the second zero-current zone according to FIG. 7A and FIG. 7B. In FIG. 7C, after the second feeding point 720*a* receives a second excitation signal, correspondingly, a second current I2 may be formed on the second antenna 720, and a second ground current GI2 may be formed on the ground plane 750. In addition, the excited second antenna 720 may form a second coupling current CI2 on the first antenna 710 by the radiation coupling mechanism. In this case, a partial ground current GI2*a* of the second ground current GI2 and a partial coupling current CI2*a* of the second coupling current CI2 may be offset by each other to form the second zero-current zone ZI2 corresponding to the second antenna 720. It should be understood that, an area (shown in dashed lines) of the second zero-current zone ZI2 in FIG. 7C is shown for example only, and is not intended to limit implementations of the disclosure.

Figure 8A:
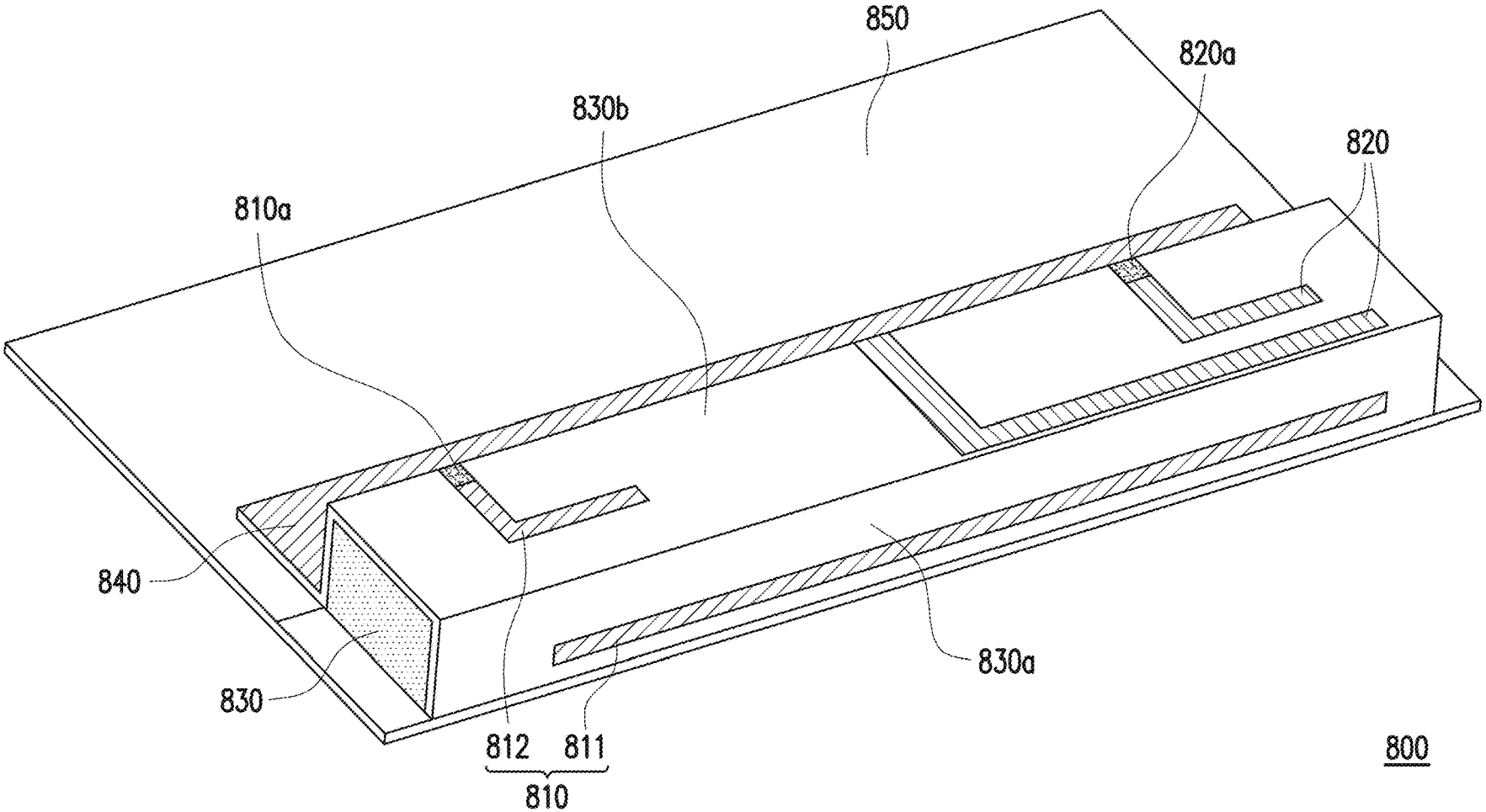
FIG. 8A is a schematic diagram of an antenna structure according to an embodiment of the disclosure.

FIG. 8A is a schematic diagram of an antenna structure according to an embodiment of the disclosure. As shown in FIG. 8A, an antenna structure 800 may include a first antenna 810, a second antenna 820, a supporting module 830, a metal layer 840, and a ground plane 850. In the present embodiment, the first antenna 810 may include a first portion 811 and a second portion 812, the first portion 811 may be disposed on a first surface 830*a* of the supporting module 830, and the second portion 812 may be disposed on a second surface 830*b* (the second surface 830*b* may be adjacent to the first surface 830*a*) of the supporting module 830. In addition, the second antenna 820 may be disposed on the second surface 830*b* of the supporting module 830. Similar to the foregoing embodiments, a first feeding point 810*a* of the first antenna 810 may be disposed in a second zero-current zone corresponding to the second antenna 820, and a second feeding point 820*a* of the second antenna 820 may be disposed in a first zero-current zone corresponding to the first antenna 810. In this way, the first antenna 810 and the second antenna 820 can be laid out with only one flexible printed circuit (FPC) or by a Laser-Direct-Structuring (LDS) technology, thereby reducing costs and difficulty in implementation.

Figure 8B:
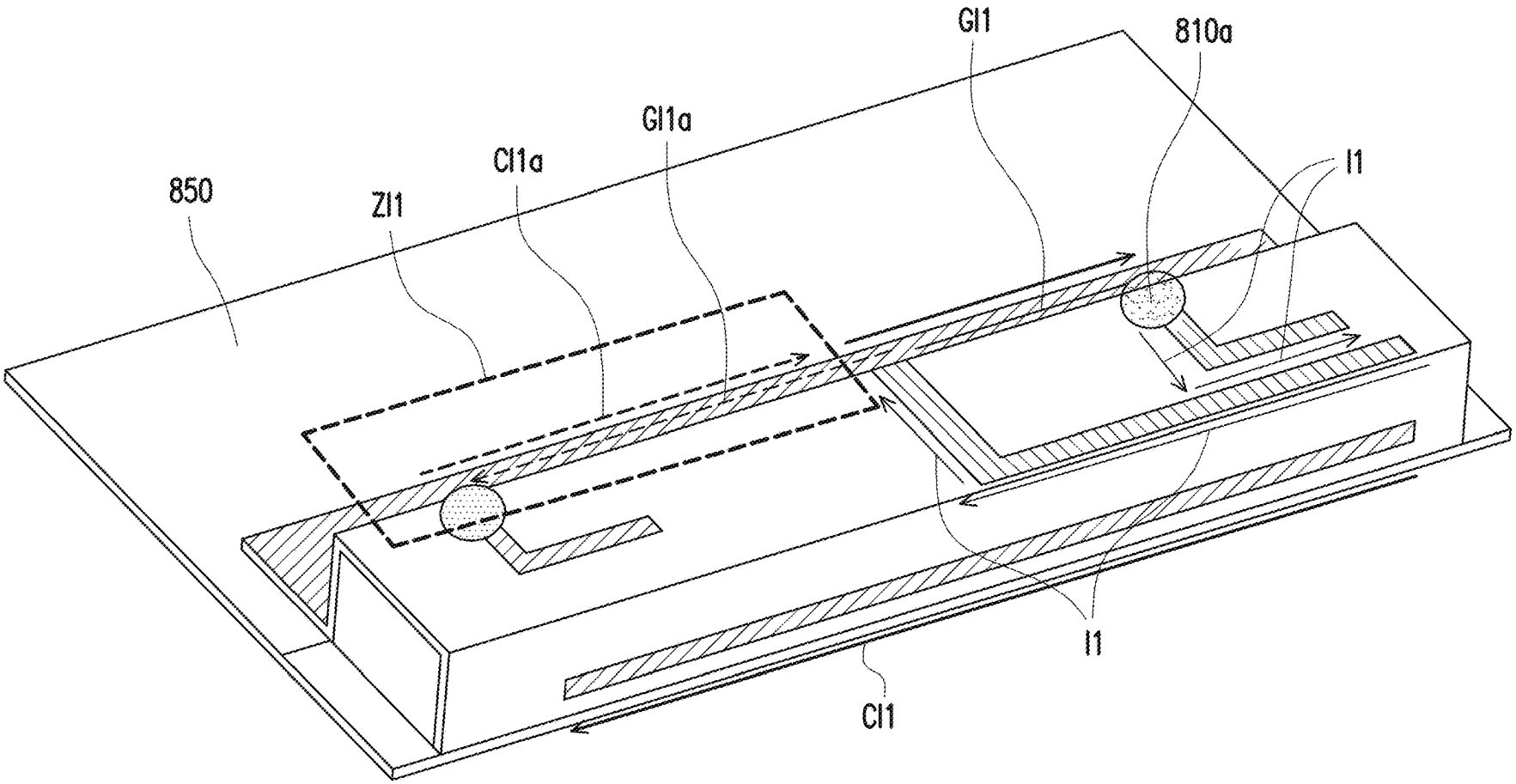
FIG. 8B is a schematic diagram of exciting a first antenna to form a first zero-current zone according to FIG. 8A.

FIG. 8B is a schematic diagram of exciting the first antenna to form the first zero-current zone according to FIG. 8A. In FIG. 8B, after the first feeding point 810*a* receives a first excitation signal, correspondingly, a first current I1 may be formed on the first antenna 810, and a first ground current GI1 may be formed on the ground plane 850. In addition, the excited first antenna 810 may form a first coupling current CI1 on the second antenna 820 by a radiation coupling mechanism. In this case, a partial ground current GI1*a* of the first ground current GI1 and a partial coupling current CI1*a* of the first coupling current CI1 may be offset by each other to form the first zero-current zone ZI1 corresponding to the first antenna 810. It should be understood that, an area (shown in dashed lines) of the first zero-current zone ZI1 in FIG. 8B is shown for example only, and is not intended to limit implementations of the disclosure.

Figure 8C:
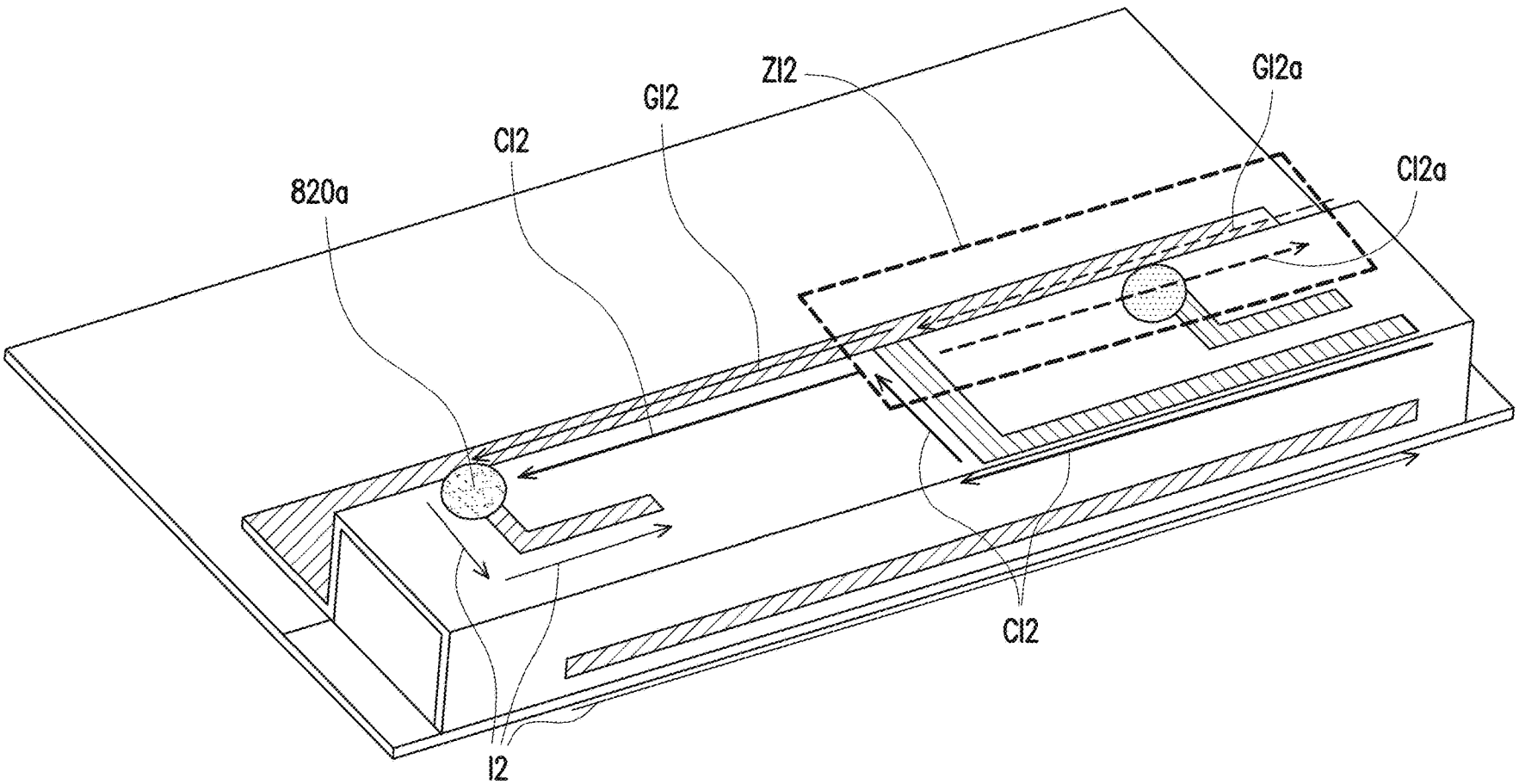
FIG. 8C is a schematic diagram of exciting a second antenna to form a second zero-current zone according to FIG. 8A and FIG. 8B.

FIG. 8C is a schematic diagram of exciting the second antenna to form the second zero-current zone according to FIG. 8A and FIG. 8B. In FIG. 8C, after the second feeding point 820*a* receives a second excitation signal, correspondingly, a second current I2 may be formed on the second antenna 820, and a second ground current GI2 may be formed on the ground plane 850. In addition, the excited second antenna 820 may form a second coupling current CI2 on the first antenna 810 by the radiation coupling mechanism. In this case, a partial ground current GI2*a* of the second ground current GI2 and a partial coupling current CI2*a* of the second coupling current CI2 may be offset by each other to form the second zero-current zone ZI2 corresponding to the second antenna 820. It should be understood that, an area (shown in dashed lines) of the second zero-current zone ZI2 in FIG. 8C is shown for example only, and is not intended to limit implementations of the disclosure.

Figure 9A:
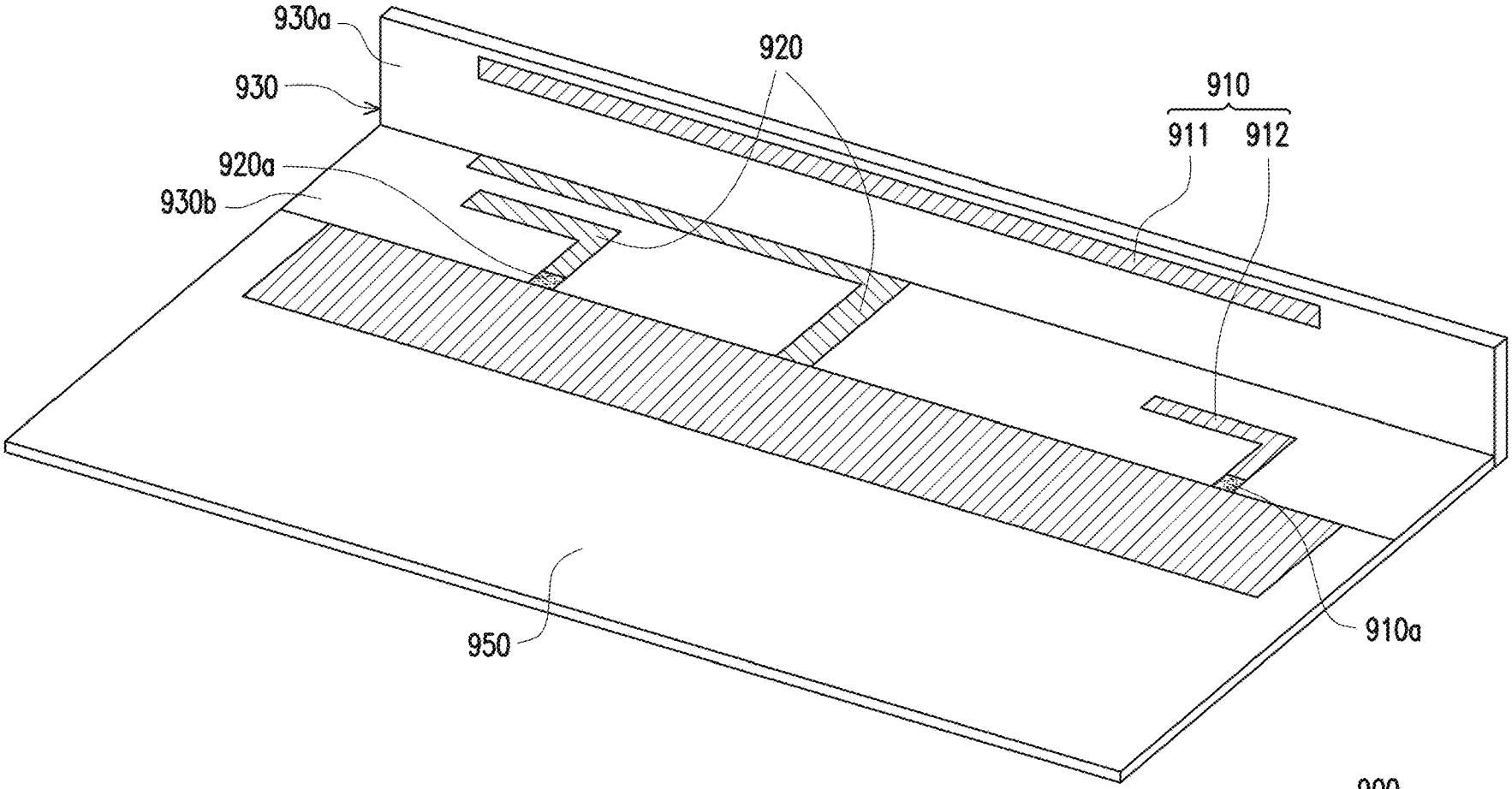
FIG. 9A is a schematic diagram of an antenna structure according to an embodiment of the disclosure.

FIG. 9A is a schematic diagram of an antenna structure according to an embodiment of the disclosure. As shown in FIG. 9A, an antenna structure 900 may include a first antenna 910, a second antenna 920, a supporting module 930, and a ground plane 950. In the present embodiment, the first antenna 910 may include a first portion 911 and a second portion 912, the first portion 911 may be disposed on a first surface 930*a* of the supporting module 930, and the second portion 912 may be disposed on a second surface 930*b* (the second surface 930*b* may be adjacent to the first surface 930*a*) of the supporting module 930. In addition, the second antenna 920 may be disposed on the second surface 930*b* of the supporting module 930. Different from the foregoing embodiments, the antenna structure 900 in FIG. 9A omits the metal layer. However, similar to the foregoing embodiments, a first feeding point 910*a* of the first antenna 910 may be disposed in a second zero-current zone corresponding to the second antenna 920, and a second feeding point 920*a* of the second antenna 920 may be disposed in a first zero-current zone corresponding to the first antenna 910. In this way, the first antenna 910 and the second antenna 920 can be laid out with only one FPC or by an LDS technology, thereby reducing costs and difficulty in implementation.

Figure 9B:
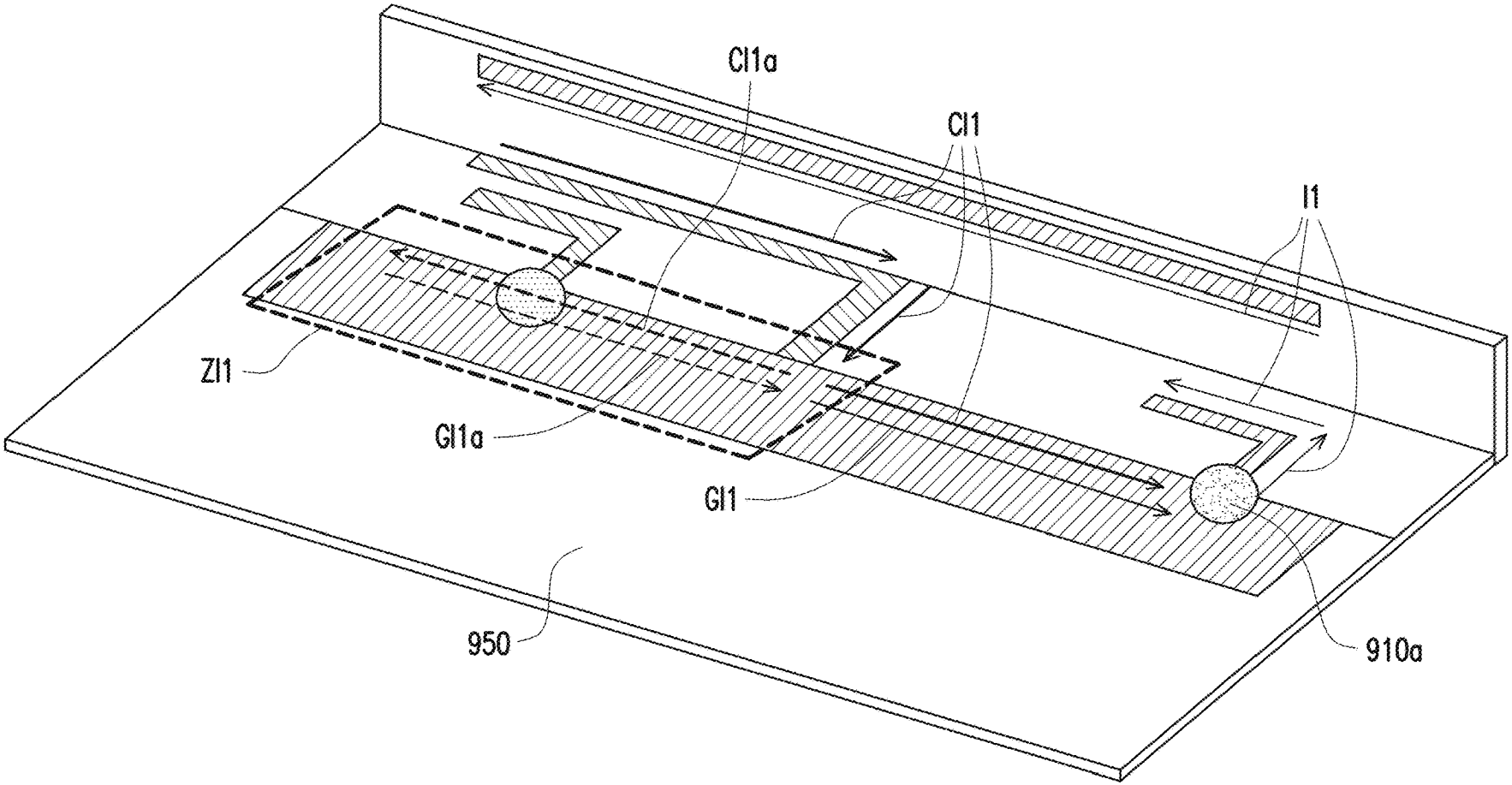
FIG. 9B is a schematic diagram of exciting a first antenna to form a first zero-current zone according to FIG. 9A.

FIG. 9B is a schematic diagram of exciting the first antenna to form the first zero-current zone according to FIG. 9A. In FIG. 9B, after the first feeding point 910*a* receives a first excitation signal, correspondingly, a first current I1 may be formed on the first antenna 910, and a first ground current GI1 may be formed on the ground plane 950. In addition, the excited first antenna 910 may form a first coupling current CI1 on the second antenna 920 by a radiation coupling mechanism. In this case, a partial ground current GI1*a* of the first ground current GI1 and a partial coupling current CI1*a* of the first coupling current CI1 may be offset by each other to form the first zero-current zone ZI1 corresponding to the first antenna 910. It should be understood that, an area (shown in dashed lines) of the first zero-current zone ZI1 in FIG. 9B is shown for example only, and is not intended to limit implementations of the disclosure.

Figure 9C:
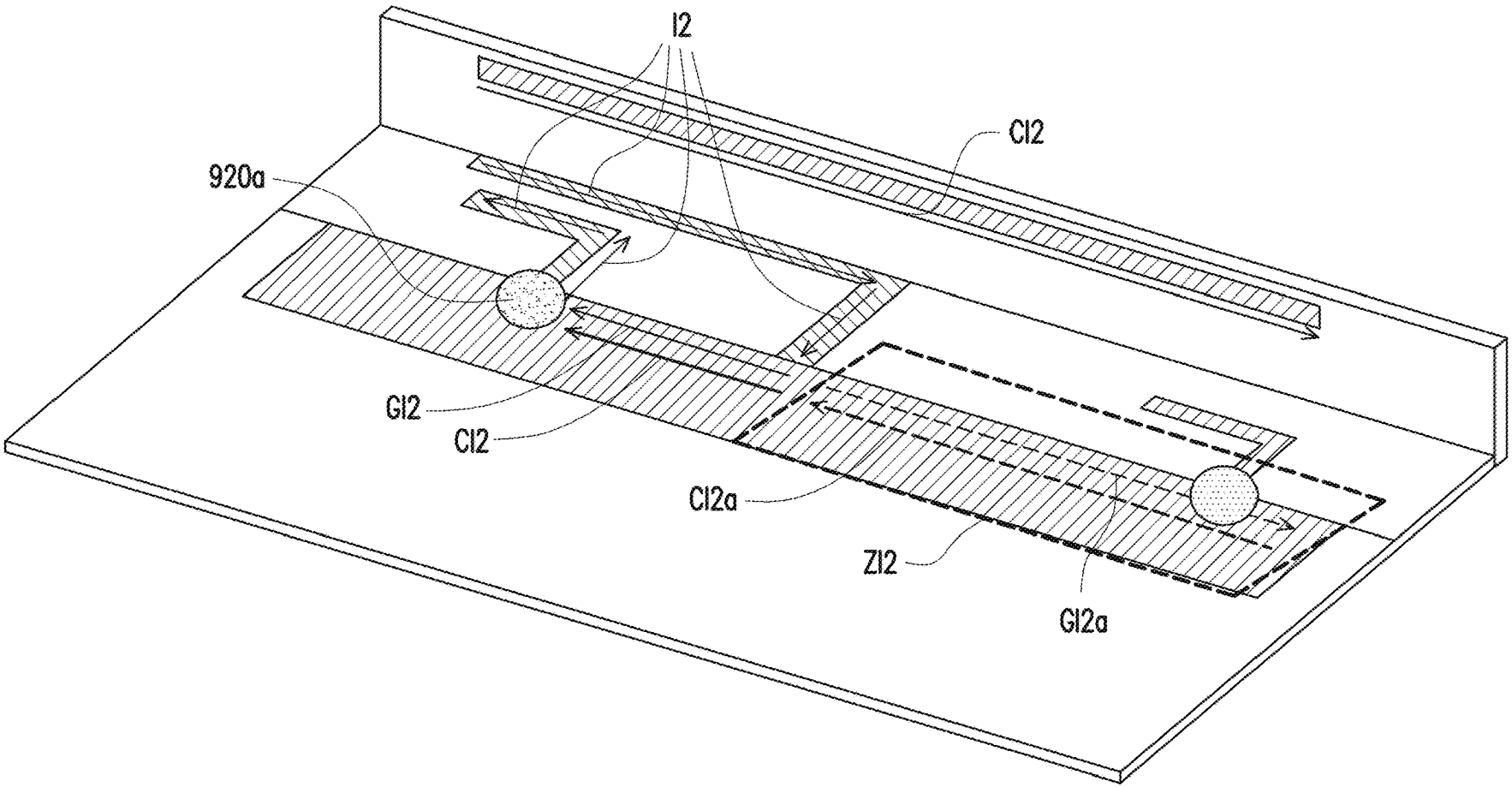
FIG. 9C is a schematic diagram of exciting a second antenna to form a second zero-current zone according to FIG. 9A and FIG. 9B.

Referring to FIG. 9C, FIG. 9C is a schematic diagram of exciting a second antenna to form a second zero-current zone according to FIG. 9A and FIG. 9B. In FIG. 9C, after the second feeding point 920*a* receives a second excitation signal, correspondingly, a second current I2 may be formed on the second antenna 920, and a second ground current GI2 may be formed on the ground plane 950. In addition, the excited second antenna 920 may form a second coupling current CI2 on the first antenna 910 by the radiation coupling mechanism. In this case, a partial ground current GI2*a* of the second ground current GI2 and a partial coupling current CI2*a* of the second coupling current CI2 may be offset by each other to form the second zero-current zone ZI2 corresponding to the second antenna 920. It should be understood that, an area (shown in dashed lines) of the second zero-current zone ZI2 in FIG. 9C is shown for example only, and is not intended to limit implementations of the disclosure.

Based on the above, the first feeding point of the first antenna is disposed in the second zero-current zone of the second antenna, and the second feeding point of the second antenna is disposed in the first zero-current zone of the first antenna, so that the antenna structure of the disclosure can provide good isolation for the first antenna and the second antenna without disposing an additional isolation component. Moreover, in some embodiments, the first antenna and the second antenna are designed as a stack structure, so that the antenna structure of the disclosure can have a smaller size, and be less restricted by space in application. In addition, in some embodiments, the first antenna (a part thereof) and the second antenna are disposed on adjacent surfaces of the supporting module, so that the first antenna and the second antenna can be laid out with only one FPC or by the LDS technology, thereby reducing costs and difficulty in implementation.

What is claimed is:

1. An antenna structure comprising:

at least one supporting module;

a first antenna disposed on the at least one supporting module and comprising a first feeding point and a first zero-current zone, wherein the first antenna is connected to a ground plane; and a second antenna disposed on the at least one supporting module and comprising a second feeding point and a second zero-current zone, wherein the second antenna is connected to the ground plane, wherein the first feeding point of the first antenna is disposed in the second zero-current zone of the second antenna, and the second feeding point of the second antenna is disposed in the first zero-current zone of the first antenna, wherein a first portion of the first antenna is disposed on a first surface of the at least one supporting module, and a first portion of the second antenna is disposed on a second surface of the at least one supporting module.

2. The antenna structure according to claim 1, wherein in response to a first excitation signal received by the first feeding point, the first antenna is excited by the first excitation signal to form the first zero-current zone.

3. The antenna structure according to claim 2, wherein the first antenna is excited by the first excitation signal to form a first ground current on the ground plane and form a first coupling current on the second antenna, and a partial ground current of the first ground current and a partial coupling current of the first coupling current are offset by each other to form the first zero-current zone.

4. The antenna structure according to claim 1, wherein in response to a second excitation signal received by the second feeding point, the second antenna is excited by the second excitation signal to form the second zero-current zone.

5. The antenna structure according to claim 4, wherein the second antenna is excited by the second excitation signal to form a second ground current on the ground plane and form a second coupling current on the first antenna, and a partial ground current of the second ground current and a partial coupling current of the second coupling current are offset by each other to form the second zero-current zone.

6. The antenna structure according to claim 1, wherein the first zero-current zone is partially distributed on the second antenna, and the second zero-current zone is partially distributed on the first antenna.

7. The antenna structure according to claim 1, wherein the first zero-current zone is partially distributed on the ground plane.

8. The antenna structure according to claim 1, wherein the at least one supporting module comprises a single supporting structure.

9. The antenna structure according to claim 8, wherein the first surface is opposite to the second surface.

10. The antenna structure according to claim 9, wherein an orthographic projection of the first portion of the first antenna on the second surface partially overlaps the first portion of the second antenna.

11. The antenna structure according to claim 8, wherein a second portion of the first antenna extends onto a third surface of the supporting module, and the third surface is adjacent to the first surface of the supporting module.

12. The antenna structure according to claim 8, wherein a second portion of the first antenna is disposed on the second surface of the supporting module, and the second surface is adjacent to the first surface of the supporting module.

13. The antenna structure according to claim 12, wherein both the first feeding point and the second feeding point are located on the second surface.

14. The antenna structure according to claim 1, wherein a structure of one of the first antenna and the second antenna is a ½-wavelength double-end short-circuit structure, and a structure of the other of the first antenna and the second antenna is a ½-wavelength double-end open-circuit structure.

15. The antenna structure according to claim 1, wherein a structure of one of the first antenna and the second antenna is a ½-wavelength double-end short-circuit structure, and a structure of the other of the first antenna and the second antenna is a ¼-wavelength resonance structure.

16. The antenna structure according to claim 1, wherein a structure of one of the first antenna and the second antenna is a ½-wavelength double-end open-circuit structure, and a structure of the other of the first antenna and the second antenna is a ¼-wavelength resonance structure.

17. The antenna structure according to claim 1, wherein structures of both the first antenna and the second antenna are ¼-wavelength resonance structures.

18. The antenna structure according to claim 1, wherein the first antenna and the second antenna are distributed on two adjacent surfaces on the supporting module.

19. The antenna structure according to claim 1, further comprising:

a metal layer disposed on the supporting module, wherein the first antenna is connected to the ground plane through the metal layer.

20. The antenna structure according to claim 19, wherein the second antenna is connected to the ground plane through the metal layer.

21. The antenna structure according to claim 19, wherein the first zero-current zone is partially distributed on the metal layer.

22. The antenna structure according to claim 1, wherein the at least one supporting module comprises a first supporting structure and a second supporting structure, wherein the first antenna is disposed on the first supporting structure, and the second antenna is disposed on the second supporting structure.

* * * * *